US011177089B2

(12) United States Patent
Zhu

(10) Patent No.: US 11,177,089 B2
(45) **Date of Patent: *Nov. 16, 2021**

(54) SWITCHING DEVICE

(71) Applicant: Gong Zhu, Xiamen (CN)

(72) Inventor: Gong Zhu, Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/945,810

(22) Filed: Aug. 1, 2020

(65) Prior Publication Data

US 2021/0193406 A1 Jun. 24, 2021

Related U.S. Application Data

(63) Continuation of application No. 16/624,992, filed on Dec. 20, 2019, now Pat. No. 10,818,445.

(51) Int. Cl.

| | |
|---|---|
| ***H01H 9/34*** | (2006.01) |
| ***H01H 9/30*** | (2006.01) |
| ***H01H 71/10*** | (2006.01) |
| ***H01H 83/20*** | (2006.01) |

(52) U.S. Cl.

CPC ..... *H01H 9/342* (2013.01); *H01H 71/1009* (2013.01); *H01H 83/20* (2013.01); *H01H 2009/305* (2013.01); *H01H 2009/348* (2013.01)

(58) Field of Classification Search

CPC ..... H01H 9/341; H01H 9/342; H01H 9/345; H01H 9/362; H01H 2009/365; H01H 2009/367; H01H 2009/305; H01H 2009/348; H01H 73/18; H01H 83/20; H01H 71/1009; H01H 33/08

USPC ..... 218/149, 49, 34, 15, 38, 46, 79, 103

See application file for complete search history.

(56) References Cited

U.S. PATENT DOCUMENTS

| | | | | |
|---|---|---|---|---|
| 4,612,426 A * | 9/1986 | Maier | H01H 9/362 | 218/151 |
| 4,877,929 A * | 10/1989 | Rival | H01H 9/36 | 218/20 |
| 6,624,373 B2 * | 9/2003 | Raabe | H01H 9/362 | 218/149 |
| 6,784,393 B2 * | 8/2004 | Bach | H01H 9/342 | 218/153 |
| 7,186,941 B2 * | 3/2007 | Yeon | H01H 9/302 | 218/149 |
| 7,674,996 B2 * | 3/2010 | Shea | H01H 9/302 | 218/34 |
| 7,705,263 B2 * | 4/2010 | Rane | H01H 9/44 | 218/149 |

* cited by examiner

*Primary Examiner* — William A Bolton

(57) ABSTRACT

A device has a movable contact, a stationary contact and an arc quenching unit, the arc quenching unit has a plurality of arc quenching plates and an electrically isolative housing, each one of the plurality of arc quenching plates has a mounting portion and a receiving portion, the receiving portion has a distributing part, the distributing part has a through hole penetrating through the receiving portion and an inclined plane protruding from the receiving portion, the inclined plane is arranged to a side of the through hole away from an arc entrance and extending to the arc entrance, an angle between the inclined plane and the receiving portion is an acute angle, a root of the inclined plane is continuous with the receiving portion. An inclined plane of a first arc quenching plate is interlacing and opposite with an inclined plane of a second arc quenching plate.

1 Claim, 11 Drawing Sheets

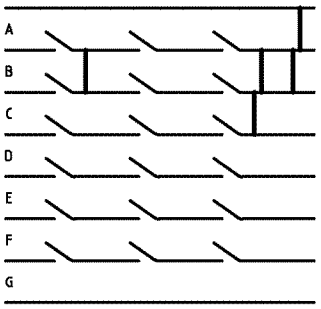
Fig. 33
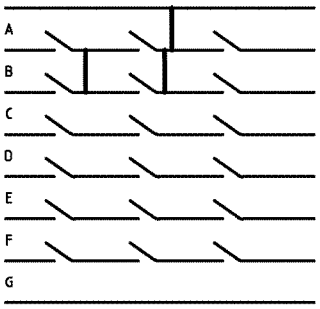
Fig. 34
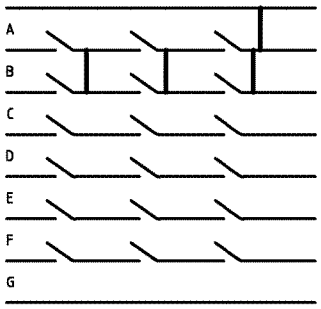
Fig. 35
Fig. 36
Fig. 37
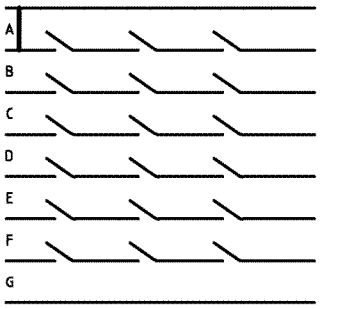
Fig. 38
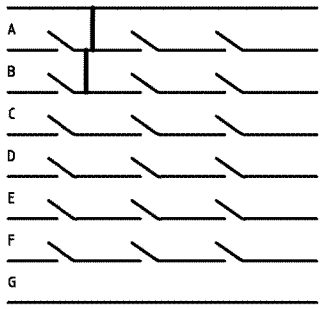
Fig. 39
Fig. 40
Fig. 41
Fig. 42
Fig. 43
Fig. 44
Fig. 45

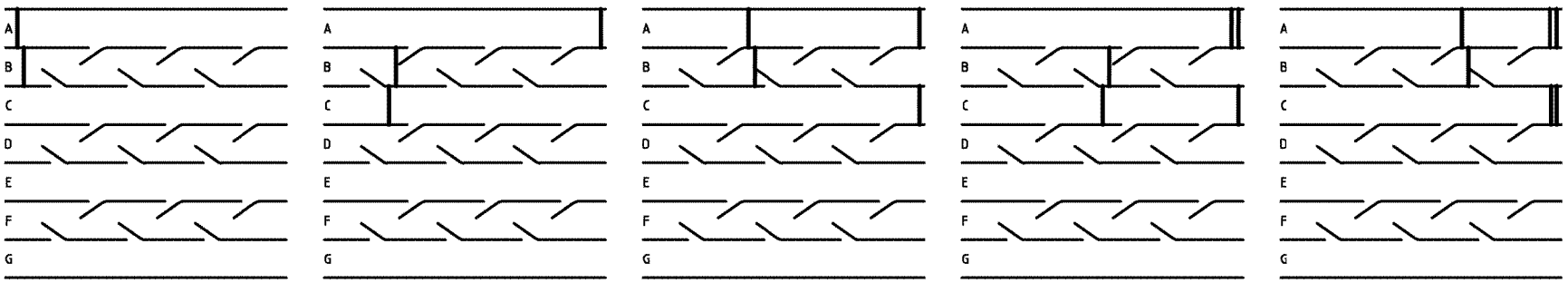
Fig. 46
Fig. 47
Fig. 48
Fig. 49
Fig. 50
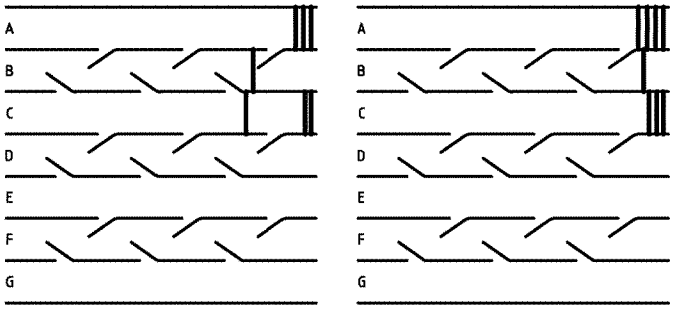
Fig. 51
Fig. 52
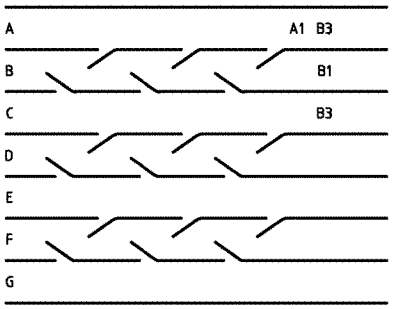
Fig. 53
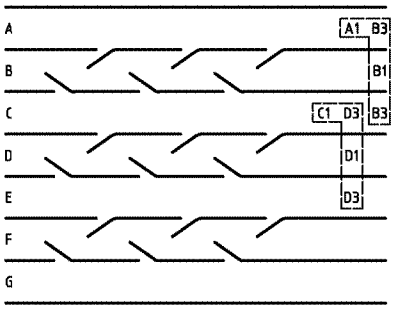
Fig. 54
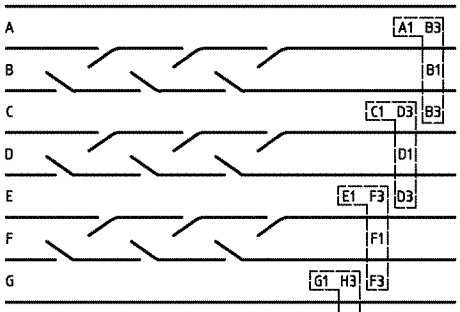
Fig. 55
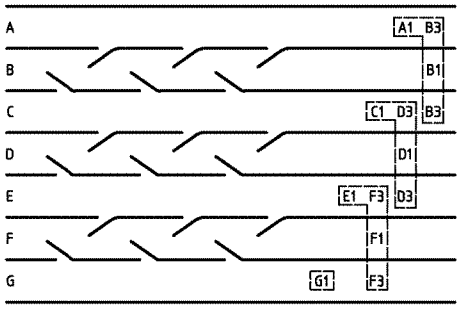
Fig. 56
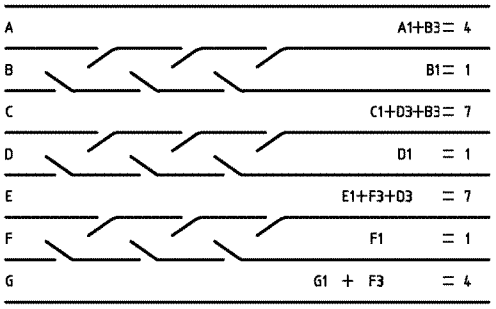
Fig. 57

SWITCHING DEVICE

CROSS-REFERENCE TO RELATED APPLICATIONS

This application is a continuation of U.S. patent application Ser. No. 16/624,992, filed Dec. 20, 2019, which is a U.S. National Phase of International Patent Application No. PCT/CN2017/088881 filed on Jun. 17, 2017. Each of the above-referenced applications is hereby incorporated herein by reference in its entirety.

BACKGROUND OF THE INVENTION

The invention relates to an electric current switching device, especially to an arc quenching plate used for quenching arcs created between a movable contact and a stationary contact.

In the field of electric current switching device, arcs can be formed between a movable contact and a stationary contact when contacts are separated from each other, arcs are pernicious, so an arc quenching unit is arranged to a switching device to quench arcs, the arc quenching unit is an arc chute with a plurality of electrically conductive plates held in an electrically isolative housing, arcs are extinguished by separating arcs into a plurality of series connecting short arcs. Surrounding gasses can be heated by arcs, gasses are quickly heated and inflated, inflated gasses enter the arc quenching unit, and finally inflated gasses are discharged out from an air outlet of the arc quenching unit. Arcs consist of a bundle of free gas which is extremely light in weight and easily deformed, and under a flowing effect of gas or liquid or an effect of electromagnetic force, arcs can move, stretch or bend quickly. Due to an action of suffered electromagnetic force or other forces (e.g. an air flow, a liquid flow), arcs are introduced into metal grid pieces, and a long arc is separated into a plurality of serially connected short arcs by a plurality of metal grid pieces. If the summation of initial dielectric strength in cathode region of all series connecting short arcs is always greater than an outer voltage applied on contacts, arcs do not reignite and are extinguished, that is, if a voltage of each single arc gap is less than dielectric strength, then arcs in each single arc gap do not reignite. If each arc in each single arc gap does not reignite any longer, then all arcs inside the arc quenching unit are extinguished. Therefore, a long arc can be separated into more short arcs, the smaller a voltage of signal arc gap is, and the more disadvantageous to the reignition of arc. Due to a restriction on an overall size of switch, the quantity of arc quenching plates is not too many, therefore, the quantity of separated short arcs is also not too many, and the total quantity of separated short arcs is the quantity of arc quenching plates subtracting one.

How to increase the quantity of short arcs separated by arc quenching plates so as to increase the arc quenching effect of quenching unit, but not to increase the quantity of arc quenching plates so as not to enlarge a overall size of switching device.

BRIEF SUMMARY OF THE INVENTION

The present invention aims to solve the above-mentioned problem and provides an arc quenching plate and an arc quenching unit comprising the arc quenching plate so as to increase the quantity of separated short arcs, and then the arc suppression effect of arc quenching unit is improved.

Such object is achieved by providing an arc quenching plate as defined in claim 1. Further advantageous according to the invention will be apparent from dependent claims.

The invention provides an arc quenching plate, which comprises a mounting portion suitable for mounting and a receiving portion suitable for receiving arcs. The receiving portion comprises a distributing part suitable for separating arcs, the distributing part comprises a through hole penetrating through the receiving portion and an inclined plane protruding from the receiving portion. The inclined plane is arranged to a side, away from an arc entrance, of the through hole and extends to the arc entrance. An angle arranged between the inclined plane and the receiving portion is an acute angle, a root of the inclined plane is continuous with the receiving portion, the receiving portion comprises one distributing part or a plurality of distributing parts.

The invention further provides an arc quenching unit comprising above arc quenching plates, the arc quenching unit comprises a plurality of arc quenching plates and an electrically isolative housing suitable for mounting the arc quenching plates, adjacent arc quenching plates are spaced to form an arc channel suitable for receiving arcs, the arc quenching plate comprises a mounting portion suitable for mounting and a receiving portion suitable for receiving an arc. The receiving portion comprises a distributing part suitable for separating arcs, the distributing part comprises a through hole penetrating through the receiving portion and an inclined plane protruding from the receiving portion, the inclined plane is arranged to a side, away from an arc entrance, of the through hole and extends to the arc entrance, an angle arranged between the inclined plane and the receiving portion is an acute angle, a root of the inclined plane is continuous with the receiving portion, the receiving portion comprises one distributing part or a plurality of distributing parts.

Optionally, an inclined plane of a first arc quenching plate is interlacing and opposite with an inclined plane of a second arc quenching plate.

The invention further provides a switching device, which comprises a movable contact, a stationary contact and an arc quenching unit used for extinguishing arcs formed between the movable contact and the stationary contact when the movable contact and the stationary contact are separated from each other, the arc quenching unit comprises a plurality of arc quenching plates and an electrically isolative housing suitable for mounting the arc quenching plate, adjacent arc quenching plates are spaced to form an arc channel suitable for receiving arcs. The arc quenching plate comprises a mounting portion suitable for mounting and a receiving portion suitable for receiving arcs, the receiving portion comprises a distributing part suitable for separating arcs, the distributing part comprises a through hole penetrating through the receiving portion and an inclined plane protruding from the receiving portion, the inclined plane is arranged to a side, away from an arc entrance, of the through hole and extends to the arc entrance, an angle arranged between the inclined plane and the receiving portion is an acute angle, a root of the inclined plane is continuous with the receiving portion, the receiving portion comprises one distributing part or a plurality of distributing parts.

Optionally, an inclined plane of a first arc quenching plate is interlacing and opposite with an inclined plane of a second arc quenching plate.

Advantageous Effects

The following beneficial effects can be obtained by adopting the arc quenching plate and the arc quenching unit disclosed by the invention:

1. In the same space, arcs can be separated into many more short arcs, and the quantity of short arcs is sharply increased.

2. The longer the total length of arc is, the contact area of arc and a surrounding medium is increased, the cooling and diffusion effects are strengthened, and the arc suppression is facilitated.

3. The longer the total length of arc is, the higher the resistance is, the more disadvantageous to the reignition of arc, and the more beneficial to arc suppression.

4. The voltage of arc gap is sharply decreased so that an opportunity that arc of arc gap is reignited is greatly reduced.

5. High-efficiency arc suppression performance of switch can be realized without adding other arc suppression components as long as distributing parts are machined on arc quenching plates of prior-art switch.

6. Distributing parts can be completed together in a blanking bending technology of arc quenching plate so that cost is hardly increased.

7. Updating of arc suppression performance of switch can be completed without changing an overall size of prior-art switch.

BRIEF DESCRIPTION OF THE SEVERAL VIEWS OF THE DRAWINGS

Further characteristics and advantages of the invention will emerge from the description of preferred, but not exclusive embodiments of an arc quenching plate according to the invention, non-limiting examples of which are provided in the attached drawings, in which:

FIGS. 33-40 are schematic views showing a first arc quenching unit distributing arcs according to Embodiment 1;

FIGS. 41-45 are schematic views showing the number of arc statistics separated by a first arc quenching unit according to Embodiment 1;

FIGS. 46-52 are schematic views showing a second arc quenching unit distributing arcs according to embodiment 2;

FIGS. 53-57 are schematic views showing the number of arc statistics separated by a second arc quenching unit according to Embodiment 2;

LIST OF REFERENCE NUMBERS

1. distributing part;
2. inclined plane;
3. through hole;
4. first arc quenching plate;
5. second arc quenching plate;
6. third arc quenching plate;
7. fourth arc quenching plate.

DETAILED DESCRIPTION OF THE INVENTION

Embodiment 1

Figure 1:
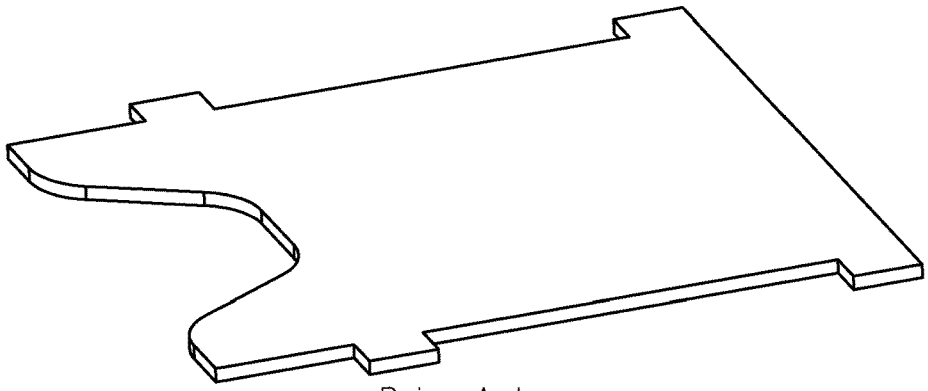
Prior Art Fig. 1
FIG. 1 is a perspective view of a traditional arc quenching plate.

FIG. 1 is a perspective view of a prior-art arc quenching plate, which comprises a mounting portion suitable for mounting and a receiving portion suitable for receiving arcs, the mounting portion comprises four lugs used for inserting into an electrically isolative housing, an arc entrance is arranged at the left side position as shown in FIG. 1, arcs move in the receiving portion after entering from the arc entrance.

Figure 2:
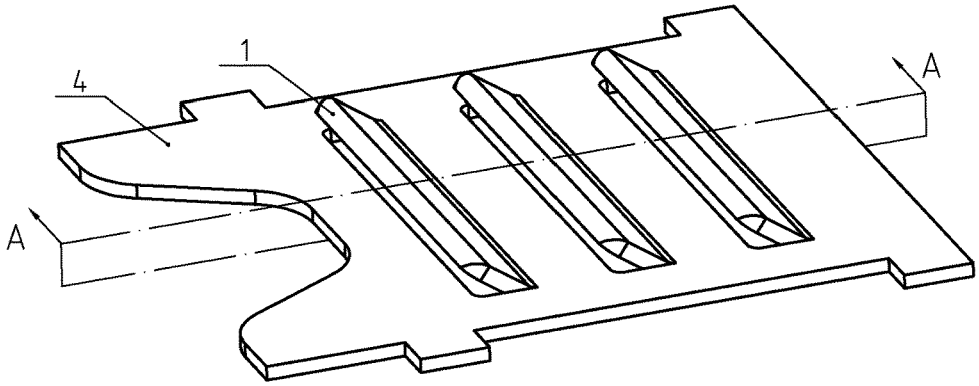
FIG. 2 is a perspective view of a first arc quenching plate according to Embodiment 1 to Embodiment 4.

FIG. 2 is a perspective view of a first arc quenching plate 4 of the invention, which comprises a mounting portion suitable for mounting and a receiving portion suitable for receiving arcs, the mounting portion comprises four lugs used for inserting into an electrically isolative housing, an arc entrance is arranged at the left side position as shown in FIG. 2, arcs move in the receiving portion after entering from the arc entrance, the receiving portion comprises a distributing part 1 suitable for separating arcs, the receiving portion is arranged along a propagation direction of arcs, the quantity of distributing parts 1 is configured according to a length of the receiving portion, the receiving portion is provided with three distributing parts 1 in Embodiment 1.

Figure 4:
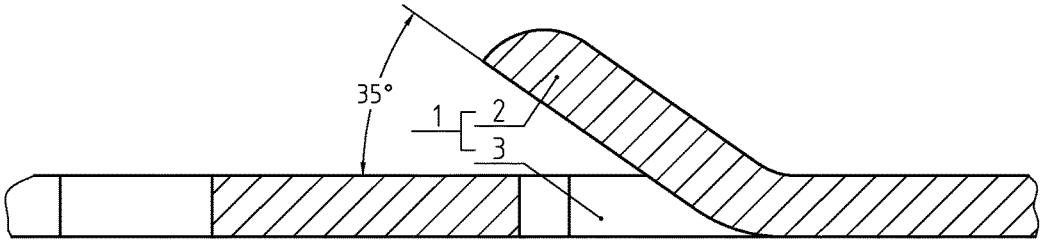
FIG. 4 is a sectional view of FIG. 2 from direction A-A.

FIG. 4 is a sectional view of the distributing part 1, which comprises a through hole 3 penetrating through the receiving portion and an inclined plane 2 protruding from the receiving portion, the inclined plane 2 is arranged to a side, away from an arc entrance, of the through hole 3 and extending to the arc entrance, an angle arranged between the inclined plane 2 and the receiving portion is an acute angle, the acute angle in Embodiment 1 is 35 degrees. A root of the inclined plane 2 is continuous with the receiving portion using an circular arc transition to connect. A distance from a projection of an end, in the receiving portion, arranged on the inclined plane 2 used for separating arcs to the arc entrance is smaller than that from an edge of the through hole 3 to the arc entrance, arcs are firstly in contact with the inclined planes 2 through such arrangement, and then arcs are separated to enter into the through hole 3 finally.

Figure 5:
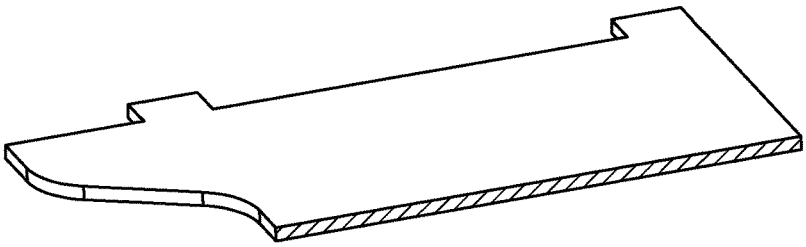
Prior Art Fig. 5
FIG. 5 is a sectional view of FIG. 1.
Figure 6:
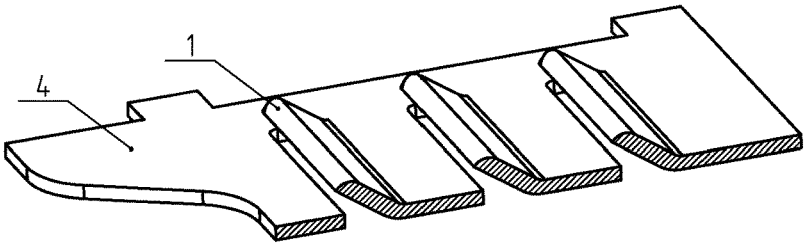
FIG. 6 is a sectional view of FIG. 2 from direction A-A.

Referring to FIGS. 5-6, a difference between a prior-art arc quenching plate and the first arc quenching plate 4 is the receiving portion, the first arc quenching plate 4 is achieved by machining the distributing part 1 on the receiving portion of a prior-art arc quenching plate, the distributing part 1 can be formed through a blanking bending forming technology.

Figure 8:
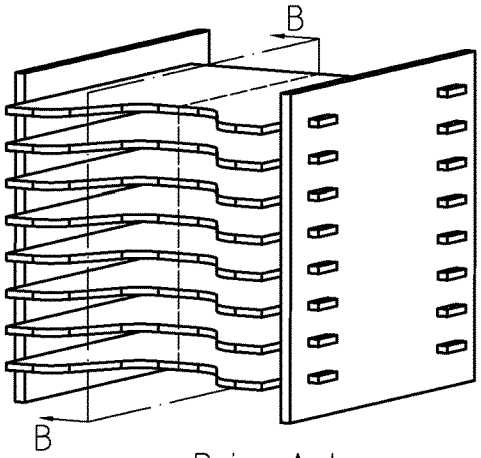
Prior Art Fig. 8
FIG. 8 is a perspective view of a traditional arc quenching unit.
Figure 10:
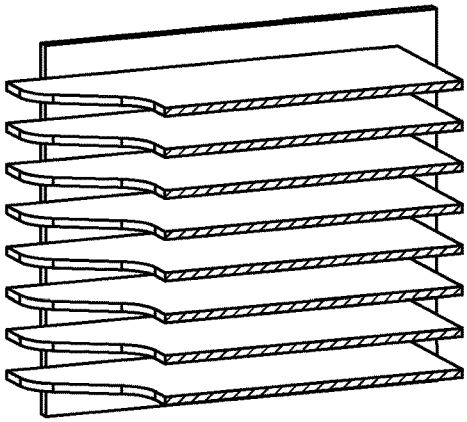
Prior Art Fig. 10
FIG. 10 is a sectional view of FIG. 8 from direction B-B.
Figure 11:
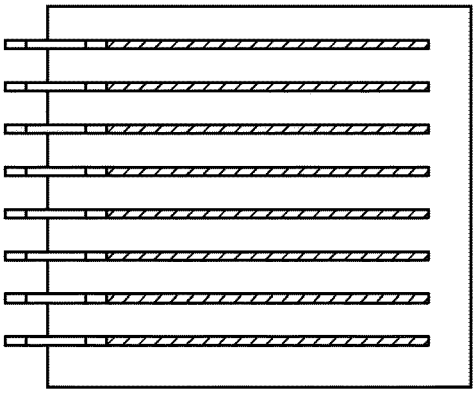
Prior Art Fig. 11
FIG. 11 is a front view of FIG. 10.

A prior-art arc quenching unit is as shown in FIGS. 8,10 and 11, which comprises eight arc quenching plates and two electrically isolative housings suitable for mounting arc quenching plates, eight arc quenching plates are housed in the two electrically isolative housings, adjacent arc quenching plates are spaced to form an arc channel suitable for receiving arcs. The mounting portion of the arc quenching plate is inserting into the electrically isolative housing and fixedly connects with the electrically isolative housing, the arc quenching plates are insulated from one another and are arranged in parallel, distances of the adjacent arc quenching plates are the same. After a long arc enters from an entrance of the arc quenching unit, the long arc is separated into seven small arcs by eight arc quenching plates, and the separated small arcs continue propagating forwards inside respective arc channels.

Figure 12:
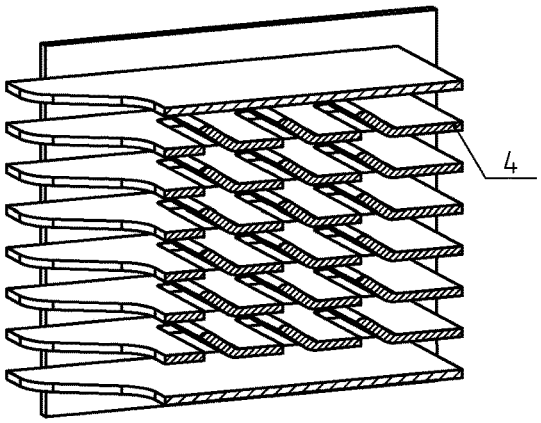
FIG. 12 is a sectional view of a first arc quenching unit according to Embodiment 1.
Figure 13:
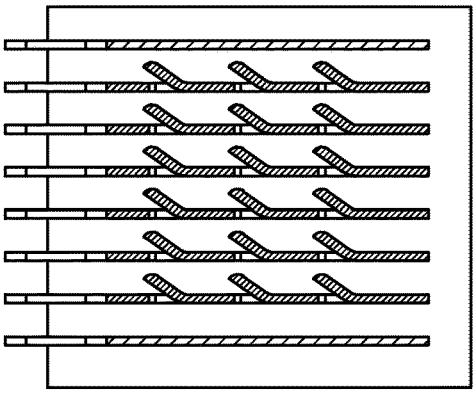
FIG. 13 is a front view of FIG. 12.

A first arc quenching unit of the invention is as shown in FIGS. 12 and 13, the first arc quenching unit comprises eight arc quenching plates and two electrically isolative housings suitable for mounting arc quenching plates, eight arc quenching plates are housed in two electrically isolative housings, six of them are the first arc quenching plates 4 and the other two are prior-art arc quenching plates, six first arc quenching plates 4 are arranged between two prior-art arc quenching plates, adjacent arc quenching plates are spaced to form an arc channel suitable for receiving arcs. The mounting portion of the arc quenching plate is inserting into the electrically isolative housing and fixedly connects with the electrically isolative housing, the arc quenching plates are insulated from one another and are arranged in parallel. When inflated gasses enter into the arc channel, inflated gasses can be separated by the distributing part 1, a part of gasses continues moving along current arc channel, and the other part of gasses is guided into the through holes 3 under an effect of the inclined plane 2 and enters into an adjacent arc channel. When a long arc enters from the entrance of the arc quenching unit, the long arc is separated into seven small arcs by the eight arc quenching plates, the separated small arcs continue propagating forwards inside arc channels, when the small arcs suffer from the distributing part 1, due to an effect of electromagnetic force or an air flow, each small arc is separated into two sections by the inclined plane 2 of the distributing part 1, one section moves along an upper surface of the inclined plane 2 and continues moving forwards in current arc channel, and the other section passes through the through hole 3 along a lower surface of the inclined plane 2 to enter into an adjacent arc channel for forward movement. Separated arcs continue moving inside arc channels, and when arcs suffer from the distributing part 1 again in the moving process, the arc is separated according to the before-mentioned separating rule again.

FIGS. 33-40 are schematic views showing the first arc quenching unit distributing arcs, arc channels are named as A, B, C, D, E, F and G from top to bottom in sequence, a black short line represents an arc, the sequence does not represent an actual sequence of actual arcs, and an arc passing through channel A is firstly taken as an example in order to facilitate statistics of the quantity of short arcs.

Referring to FIG. 33, an arc is positioned at an arc entrance of channel A.

The arc is separated into two sections for a first time inside arc channel A, one section continues moving inside arc channel A, the other section moves into arc channel B, as shown in FIG. 34.

The arc is separated into two sections for a second time inside arc channel A, one section continues moving inside arc channel A, the other section moves into arc channel B, as shown in FIG. 35.

The arc is separated into two sections for a third time in arc channel A, one section continues moving inside arc channel A, the other section moves into arc channel B, as shown in FIG. 35, right now, arc channel A is internally provided with one section of arc, and arc channel B is internally provided with three sections of arc.

A second section of arc inside arc channel B in FIG. 36 is separated into two sections, one section continues moving inside arc channel B, the other section moves into arc channel C, as shown in FIG. 37.

A first section of arc inside arc channel B in FIG. 37 is separated into two sections, one section continues moving inside arc channel B, the other section moves into arc channel C, as shown in FIG. 38.

A first section of arc inside arc channel B in FIG. 38 is separated into two sections, one section continues moving inside arc channel B, the other section moves into arc channel C, as shown in FIG. 39.

A first section of arc inside arc channel C in FIG. 39 is separated into two section, one section continues moving inside arc channel B, the other section moves into arc channel D, as shown in FIG. 40. Right now, a separating of an arc originally positioned at the entrance of channel A is completed, the number of sections after separating is as follows: arc channel A is internally provided with one section of arc, arc channel B is internally provided with three sections of arc, arc channel C is internally provided with one section of arc, and arc channel D is internally provided with one section of arc. In order to facilitate analysis, the separating condition is represented by a combination of a letter and a number, a previous letter represents an arc channel where arcs in the entrance of the arc quenching unit are, and a later number represents the quantity of short arcs of current arc channel.

Therefore, the separating condition of one section of arc after passing through arc channel A is A1, A3, A3, A1. As shown in FIG. 41, in order to facilitate observation and analysis, the combination is surrounded by using an imaginary line, as shown in FIG. 42.

Similarly, the separating condition of one section of arc after passing through arc channel B is B1, B3, B3, B1, as shown in FIG. 42.

Similarly, the separating condition of one section of arc after passing through arc channel C is C1, C3, C3, C1, as shown in FIG. 43.

Similarly, the separating condition of one section of arc after passing through arc channel D is D1, D3, D3, D1, as shown in FIG. 43.

Similarly, the separating condition of one section of arc after passing through arc channel E is E1, E3, E3, E1, as shown in FIG. 43.

Similarly, the separating condition of one section of arc after passing through arc channel F is F1, F3, F3, F1, as shown in FIG. 43.

Similarly, the separating condition of one section of arc after passing through arc channel G is G1, G3, G3, G1, as shown in FIG. 43.

Since no other arc channel exists under arc channel G, combinations of letter and number positioned outside arc channels are removed, and combinations of letter and number positioned inside arc channels are maintained, as shown in FIG. 44.

Finally, numbers inside each arc channel are added together, namely the total quantity of short arcs inside each channel can be obtained, as shown in FIG. 45, and then the total quantity of short arcs of each channel is aggregated, namely the quantity of short arcs of a whole arc quenching unit can be obtained.

Through above-mentioned analytic statistics, a long arc is separated into 44 sections of short arc after passing through the first arc quenching unit. However, by using a prior-art arc quenching unit, a long arc is separated into only seven sections of short arc, the quantity of short arcs separated by the first arc quenching unit is more than six times of the quantity of short arcs separated by the prior-art arc quenching unit, and the quantity of the separated short arcs is sharply increased so that following beneficial effects can be obtained.

1. The larger the quantity of short arc is, the longer the total length of arc is, the higher the resistance is, the more disadvantageous to the reignition of arc, and the more beneficial to an arc suppression.

2. The larger the quantity of short arc is, the longer the total length of arc is, a contact area of arc and a surrounding medium is increased, the cooling and diffusion effects are strengthened, and an arc suppression is facilitated.

3. The larger the quantity of short arc is, the smaller the voltage of an arc gap is, and an opportunity that arcs of arc gap are reignited is greatly reduced.

So the arc suppression performance of the first arc quenching unit is more than six times of the arc suppression performance of a prior-art arc quenching unit.

If the summation of initial medium strengths of all serially connected short arc cathode regions is always greater than an applied voltage between contacts, arcs are extinguished without being reignited, that is, if a voltage of signal arc gap is greater than a medium recovery strength, arcs of a single arc gap are not reignited, and if arcs of each arc gap are not reignited any longer, arcs inside the whole arc quenching unit are extinguished. Therefore, a long arc can be separated into more short arcs, the smaller the voltage of the signal arc gap is, and the more disadvantageous to the reignition of arc.

In the first arc quenching unit, arc quenching plates between two arc quenching plates at the head and the tail in a prior-art arc quenching unit are substituted for the first arc quenching plates 4, the total quantity of arc quenching plates and the total quantity of arc channels remain unchanged, the quantity of arc quenching plates is eight, the quantity of arc channels is seven, and a boundary dimension of whole arc quenching unit remains unchanged. A long arc is separated into 44 sections of short arcs after passing through the first arc quenching unit, and the prior-art arc suppression is separated into only seven sections of short arc.

A distribution of magnetic field is non-uniform or an arc suffers from a non-uniform magnetic field, thus, electromagnetic forces of all sections of short arc at the entrance of the arc quenching unit are different, movement speeds of all sections of short arc are also different, and the short arcs after arcs inside arc channels are separated by the distributing parts 1 are avoided from being fused with the short arcs after arcs inside adjacent arc channels are separated by the distributing parts 1.

Embodiment 2

Figure 3:
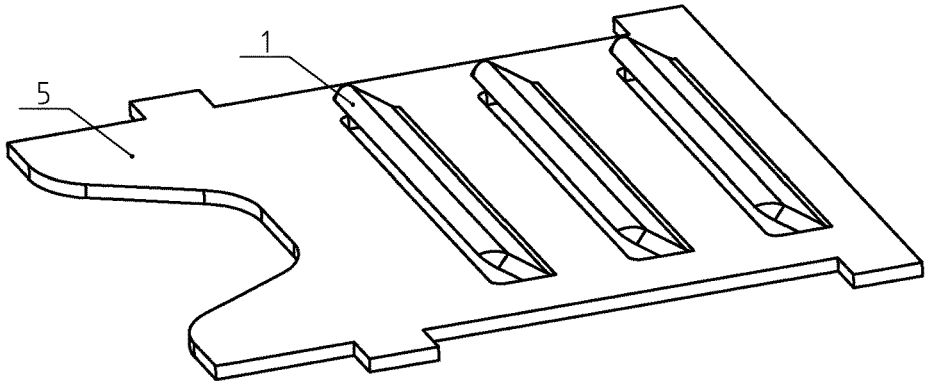
FIG. 3 is a perspective view of a second arc quenching plate according to Embodiment 2 and Embodiment 4.
Figure 7:
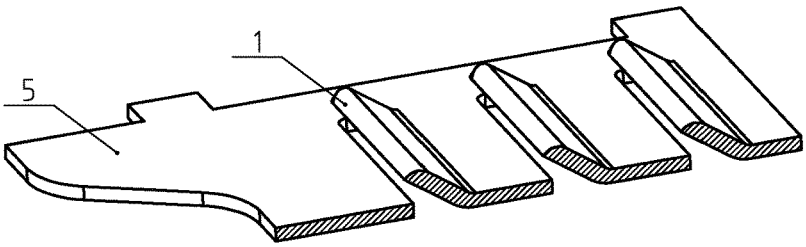
FIG. 7 is a sectional view of FIG. 3.

FIG. 3 is a perspective view of a second arc quenching plate 5 of the invention, FIG. 7 is a sectional view of the second arc quenching plate 5; the second arc quenching plate 5 is obtained by moving three distributing parts 1 on the first arc quenching plate 4 according to Embodiment 1 towards a propagation direction of arc at intervals, a movement distance is half of a distance between adjacent distributing parts 1, for a purpose that the first arc quenching plate 4 and the second arc quenching plate 5 are arranged in opposite directions, the distributing parts 1 on the first arc quenching plate 4 and the distributing parts 1 on the second arc quenching plate 5 are staggered from one another.

Figure 9:
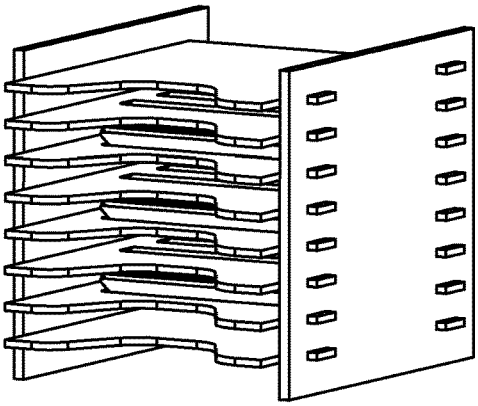
FIG. 9 is a perspective view of a second arc quenching unit according to Embodiment 2.

FIG. 9 is a perspective view of a second arc quenching unit of the invention, in the second arc quenching unit, three first arc quenching plates 4 in the first arc quenching unit according to Embodiment 1 are substituted for the second arc quenching plates 5 so that the first arc quenching plates 4 and the second arc quenching plates 5 are arranged in a staggered manner.

Figure 14:
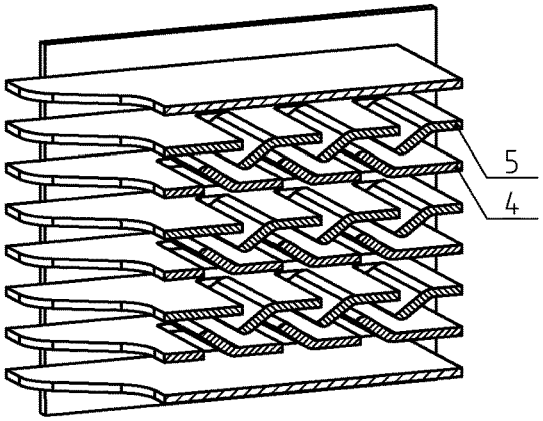
FIG. 14 is a sectional view of a second arc quenching unit according to Embodiment 2.
Figure 15:
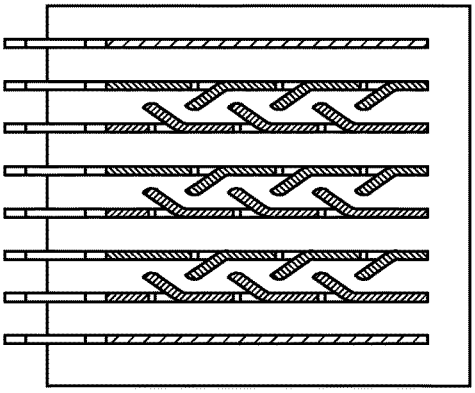
FIG. 15 is a front view of FIG. 14.

In the second arc quenching unit as shown in FIG. 14 and FIG. 15, an inclined plane 2 of the first arc quenching plate 4 and an inclined plane 2 of the second arc quenching plate 5 are staggered and are arranged in opposite directions.

FIGS. 46-57 are schematic views showing the second arc quenching unit distributing arcs, arc channels are named as A, B, C, D, E, F and G from top to bottom in sequence. A black short line represents an arc, the sequence does not represent an actual sequence of actual arc, and an arc passing through arc channel A and another arc passing through arc channel B are firstly taken as an example in order to facilitate statistics of the quantity of short arcs.

Referring to FIG. 46, an arc is positioned at an entrance of arc channel A, another arc is positioned at an entrance of arc channel B.

The arc inside arc channel A directly passes through arc channel A without being separated, the arc inside arc channel B is separated into two sections for a first time inside arc channel B, one section continues moving inside arc channel B, the other section moves into arc channel C, as shown in FIG. 47.

The arc inside arc channel C directly passes through arc channel C without being separated, the arc inside arc channel B is separated into two sections for a second time inside arc channel B, one section continues moving inside arc channel B, the other section moves into arc channel A, as shown in FIG. 48.

The arc inside arc channel A directly passes through arc channel A without being separated, the arc inside arc channel B is separated into two sections for a third time inside arc channel B, one section continues moving inside arc channel B, the other section moves into arc channel C, as shown in FIG. 49.

The arc inside arc channel C directly passes through arc channel C without being separated, the arc inside arc channel B is separated into two sections for a fourth time inside arc channel B, one section continues moving inside arc channel B, the other section moves into arc channel A, as shown FIG. 50.

The arc inside arc channel A directly passes through arc channel A without being separated, the arc inside arc channel B is separated into two sections for a fifth time inside arc channel B, one section continues moving inside arc channel B, the other section moves into arc channel C, as shown in FIG. 51.

The arc inside arc channel C directly passes through arc channel C without being separated, the arc inside arc channel B is separated into two sections for a sixth time inside arc channel B, one section continues moving inside arc channel B, the other section moves into arc channel A, as shown in FIG. 52. Right now, a separating of an arc originally positioned at the entrance of arc channel B is completed, the number of sections after separating are as follows: arc channel A is internally provided with three sections of arc, arc channel B is internally provided with one section of arc, and arc channel C is internally provided with three sections of arc. However, an arc originally positioned at the entrance of channel A directly passes through arc channel A without being separated, and thus finally, arc channel A is internally provided with one section of arc without being separated by arc channel A and three sections of arc separated by arc channel B. In order to facilitate analysis, the separating condition is represented by a combination of a letter and a number, a previous letter represents an arc channel where arcs in the entrance of the arc quenching unit are, and a later number represents the quantity of short arcs of the current channel.

Therefore, the separating condition of one section of arc after passing through arc channel A and one section of arc after passing through arc channel B is A1, B3, B1 and B3, as shown in FIG. 53. In order to facilitate observation and analysis, the combination is surrounded by using an imaginary line, as shown in FIG. 54.

Similarly, the separating condition of one section of arc after passing through arc channel C and one section of arc after passing through arc channel D is C1, D3, D1 and D3, as shown in FIG. 54.

Similarly, the separating condition of one section of arc after passing through arc channel E and one section of arc after passing through arc channel F is E1, F3, F1 and F3, as shown in FIG. 55.

Similarly, the separating condition of one section of arc after passing through arc channel G and one section of arc after passing through arc channel H is G1, H3, H1 and H3, as shown in FIG. 55.

Since no other channel exists under arc channel G, combinations of letter and number positioned outside arc channels are removed, and combinations of letter and number positioned inside arc channels are maintained, as shown in FIG. 56.

Finally, numbers inside each channel are added, namely the total quantity of short arcs inside each arc channel can be obtained, as shown in FIG. 57, and then the total quantity of short arcs of each arc channel is aggregated, namely the quantity of final short arcs of whole arc quenching unit can be obtained.

Through above-mentioned analytic statistics, a long arc is separated into 25 sections of short arc after passing through the second arc quenching unit. However, in a prior-art arc quenching unit, a long arc is separated into only seven sections of short arc, the quantity of short arcs separated by the second arc quenching unit is more than three times of the quantity of short arcs separated by the prior-art arc quenching unit, and the quantity of separated short arcs is sharply increased so that following beneficial effects can be obtained.

1. The larger the quantity of short arc is, the longer the total length of arc is, the higher the resistance is, the more disadvantageous to the reignition of arc, and the more beneficial to an arc suppression.

2. The larger the quantity of short arc is, the longer the total length of arc is, a contact area of arc and a surrounding medium is increased, the cooling and diffusion effects are strengthened, and an arc suppression is facilitated.

3. The larger the quantity of short arc is, the smaller the voltage of an arc gap is, and an opportunity that arcs of arc gap are reignited is greatly reduced.

The arc suppression performance of the second arc quenching unit is more than three times of the arc suppression performance of a prior-art arc quenching unit.

Embodiment 3

Figure 16:
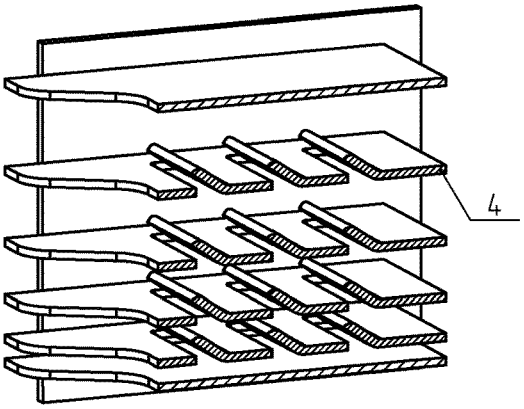
FIG. 16 is a sectional view of a third arc quenching unit according to Embodiment 3.
Figure 17:
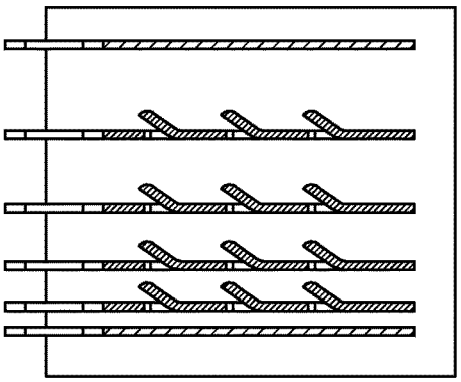
FIG. 17 is a front view of FIG. 16.

Referring to FIG. 16 and FIG. 17, a third arc quenching unit is disclosed by the invention, the quantity of the first arc quenching plates 4 in the first arc quenching unit according to Embodiment 1 is decreased to be four from six, and meanwhile distances between adjacent arc quenching plates are different. The distances between adjacent arc quenching plates are different, and thus an arc can be separated into five sections of short arc with different lengths after entering into the arc entrance of the third arc quenching unit. Lengths of section of short arc are different, thus, electromagnetic forces of all sections of short arc are also different, movement speeds of all sections of short arc are also different, and short arcs after that arcs inside arc channels are separated by the distributing parts 1 are avoided from being fused with short arcs after that arcs inside adjacent arc channels are separated by the distributing parts 1.

Embodiment 4

Figure 18:
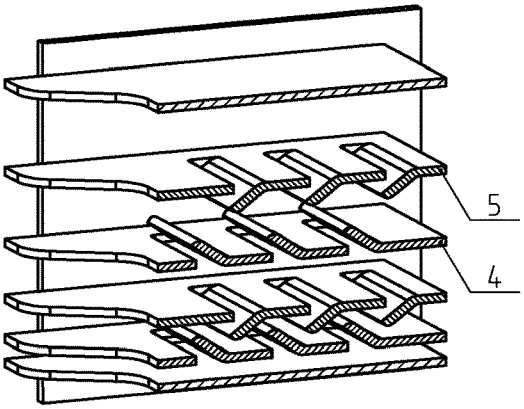
FIG. 18 is a sectional view of a fourth arc quenching unit according to Embodiment 4.
Figure 19:
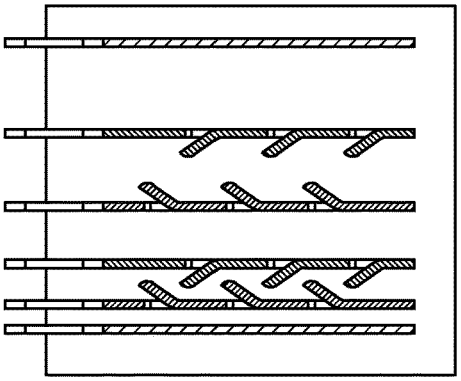
FIG. 19 is a front view of FIG. 18.

Referring to FIG. 18 and FIG. 19, a fourth arc quenching unit is disclosed by the invention, the two first arc quenching plates 4 in the third arc quenching unit according to Embodiment 3 are substituted for the second arc quenching plates 5 so that the first arc quenching plate 4 and the second arc quenching plate 5 are arranged alternately, and the inclined plane 2 of the first arc quenching plate 4 and the inclined plane 2 of the second arc quenching plate 5 are staggered and arranged in opposite directions.

Embodiment 5

Figure 20:
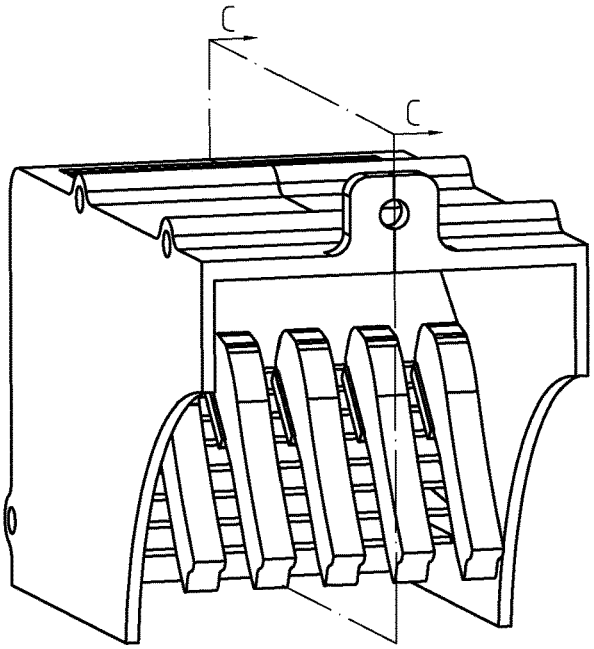
Prior Art Fig. 20
FIG. 20 is a perspective view of a traditional arc quenching unit.
Figure 21:
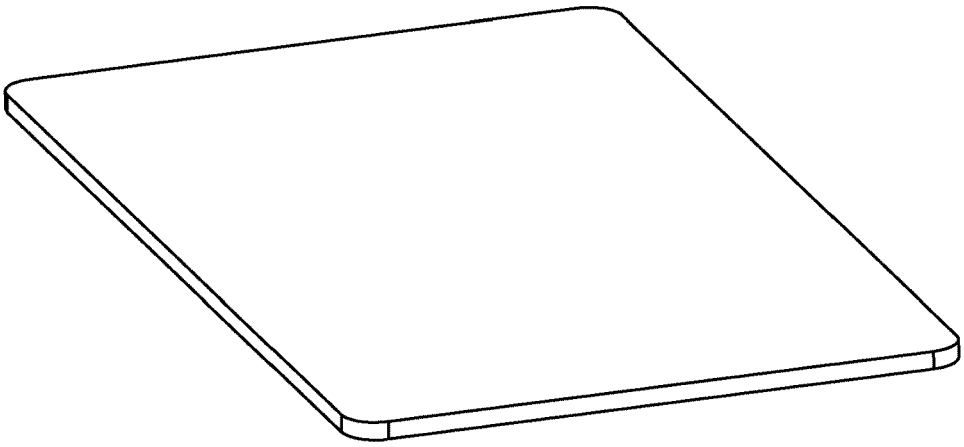
Prior Art Fig. 21
FIG. 21 is a perspective view of a traditional arc quenching plate.

Referring to FIG. 20, another prior-art arc quenching unit is used for high-current switches, and turning-on or turning-off of one-phase current is completed by multiple movable contacts together. Referring to FIG. 21, in arc quenching plates, each arc quenching plate is provided with a mounting portion used for mounting and a receiving portion used for receiving arcs, the mounting portion at two ends is embedded into a groove formed in the corresponding electrically isolative housing respectively, as shown in FIG. 21, an arc entrance is arranged at a left side position, and arcs move in the receiving portion after entering from the arc entrance.

Figure 22:
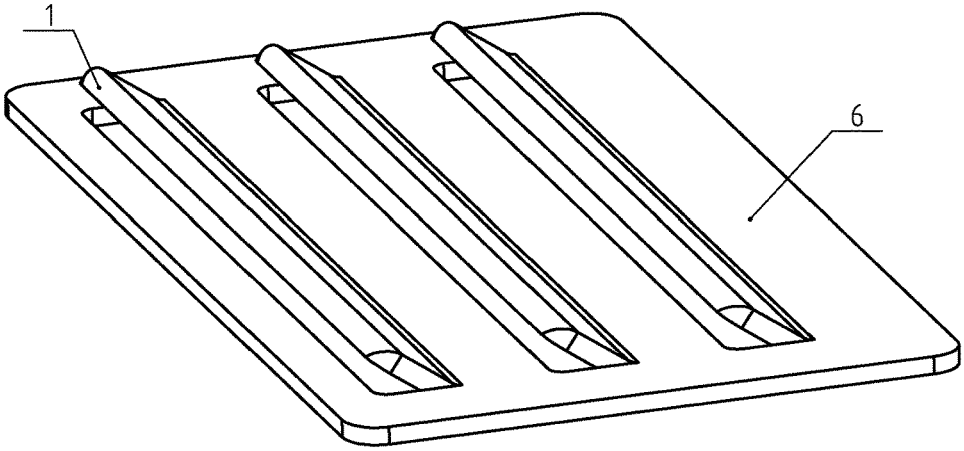
FIG. 22 is a perspective view of a third arc quenching plate according to Embodiment 5 and Embodiment 6.

Referring to FIG. 22, a first arc quenching plate 4 is disclosed by the invention, the first arc quenching plate 4 comprises a mounting portion suitable for mounting and a receiving portion suitable for receiving arcs, the mounting portion respectively inserts into a relative recess of an electrically isolative housing, an arc entrance is arranged at a left side position as shown in FIG. 22, arcs move in the receiving portion after entering from the arc entrance, the receiving portion is provided with a distributing part 1 used for separating arcs, the receiving portion is arranged along a propagation direction of arc, the quantity of the distributing parts 1 is selected according to a length of the receiving portion, and the receiving portion is provided with three distributing parts 1 in Embodiment 5.

Figure 24:
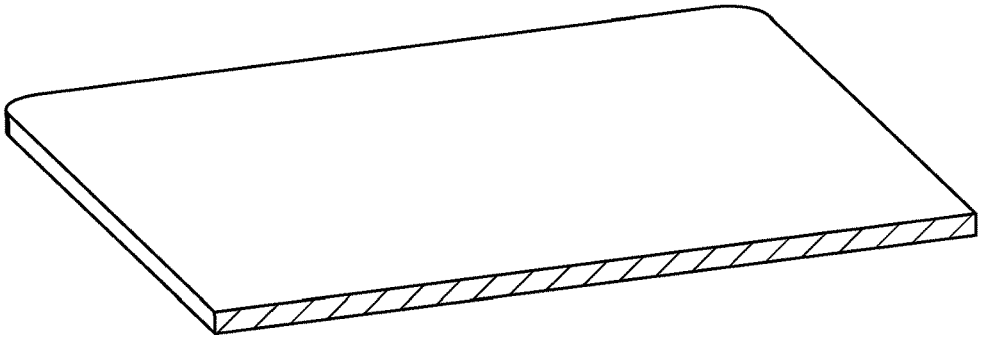
Prior Art Fig. 24
FIG. 24 is a sectional view of FIG. 21.
Figure 25:
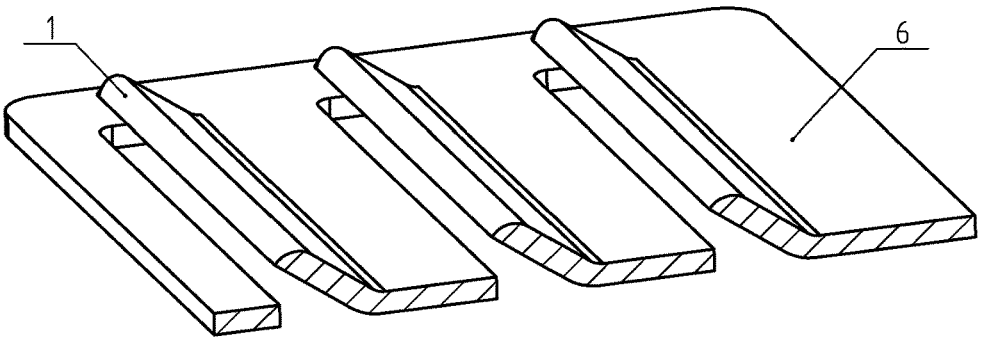
FIG. 25 is a sectional perspective view of FIG. 22.

Referring to FIG. 24 and FIG. 25, a difference between a prior-art arc quenching plate and the first arc quenching plate 4 is the receiving portion, the first arc quenching plate 4 can be obtained by machining the distributing part 1 on the receiving portion of a prior-art arc quenching plate, and the distributing part 1 can be formed through a blanking bending forming technology.

Figure 27:
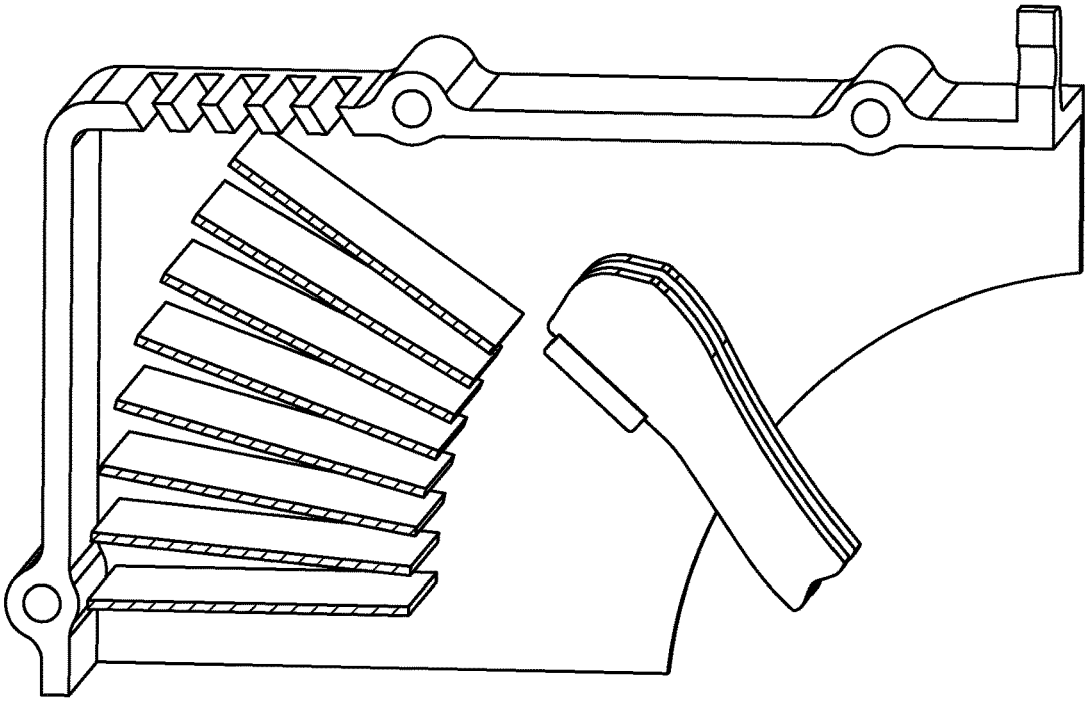
Prior Art Fig. 27
FIG. 27 is a sectional perspective view of FIG. 20.
Figure 28:
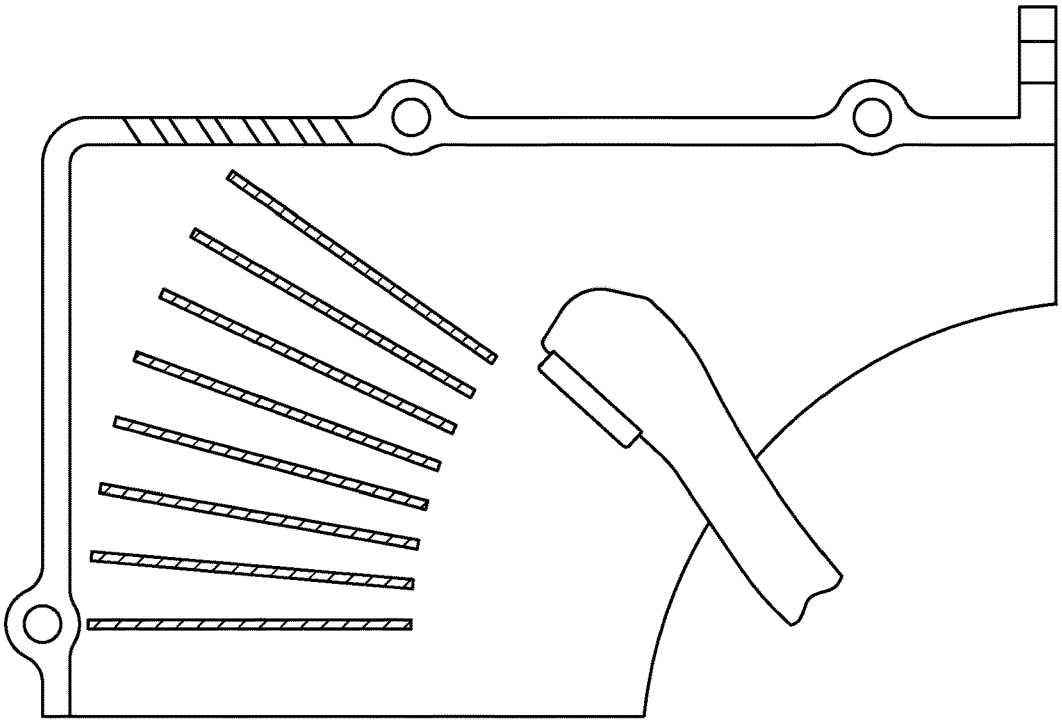
Prior Art Fig. 28
FIG. 28 is a front view of FIG. 27.

Referring to FIG. 27 and FIG. 28, another type of prior-art arc quenching unit as shown in FIG. 20 comprises eight arc quenching plates and two electrically isolative housings suitable for mounting arc quenching plates, one of electrically isolative housing has been removed, eight arc quenching plates are housed in two electrically isolative housings, adjacent arc quenching plates are spaced to form an arc channel suitable for receiving arcs. The mounting portion at two ends are embedded into a groove formed in the corresponding electrically isolative housing respectively, and the arc quenching plate is fixed inside the corresponding groove by screwing and fastening the two electrically isolative housing. Arc quenching plates are isolative from each other, angles arranged between two adjacent arc quenching plates are identical. After a long arc enters from an entrance of the arc quenching unit, the long arc is separated into seven small arcs by eight arc quenching plates, and the separated small arcs continue propagating forwards inside respective arc channels.

Figure 29:
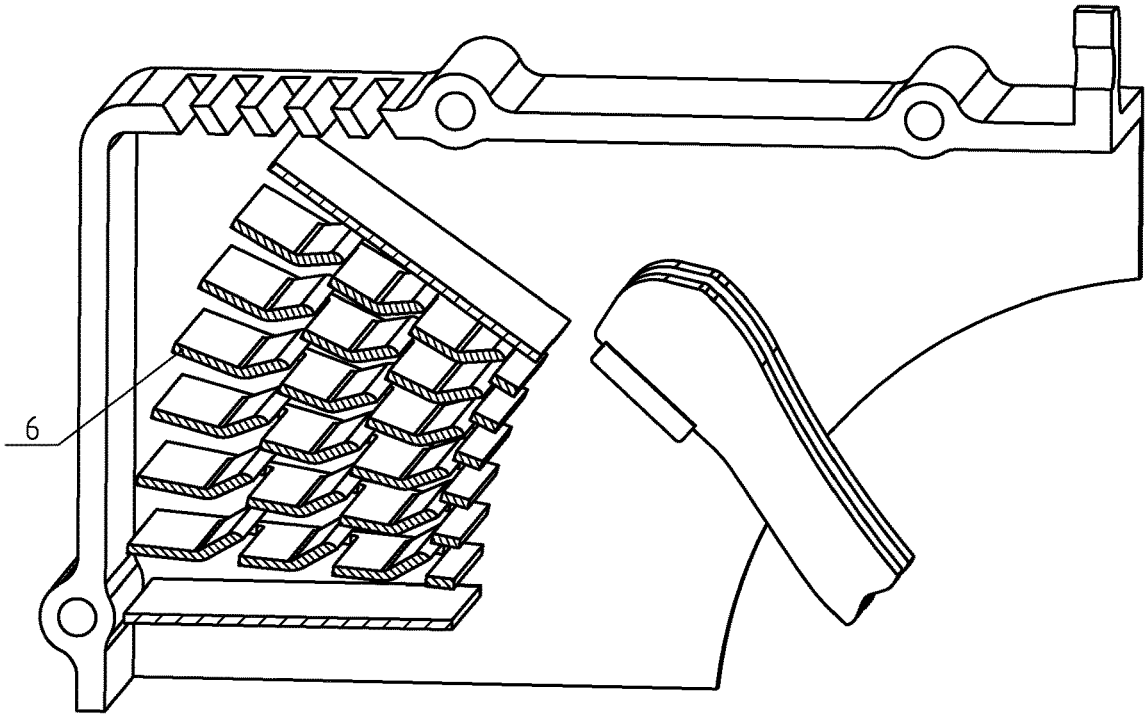
FIG. 29 a sectional view of a fifth arc quenching unit according to Embodiment 5.
Figure 30:
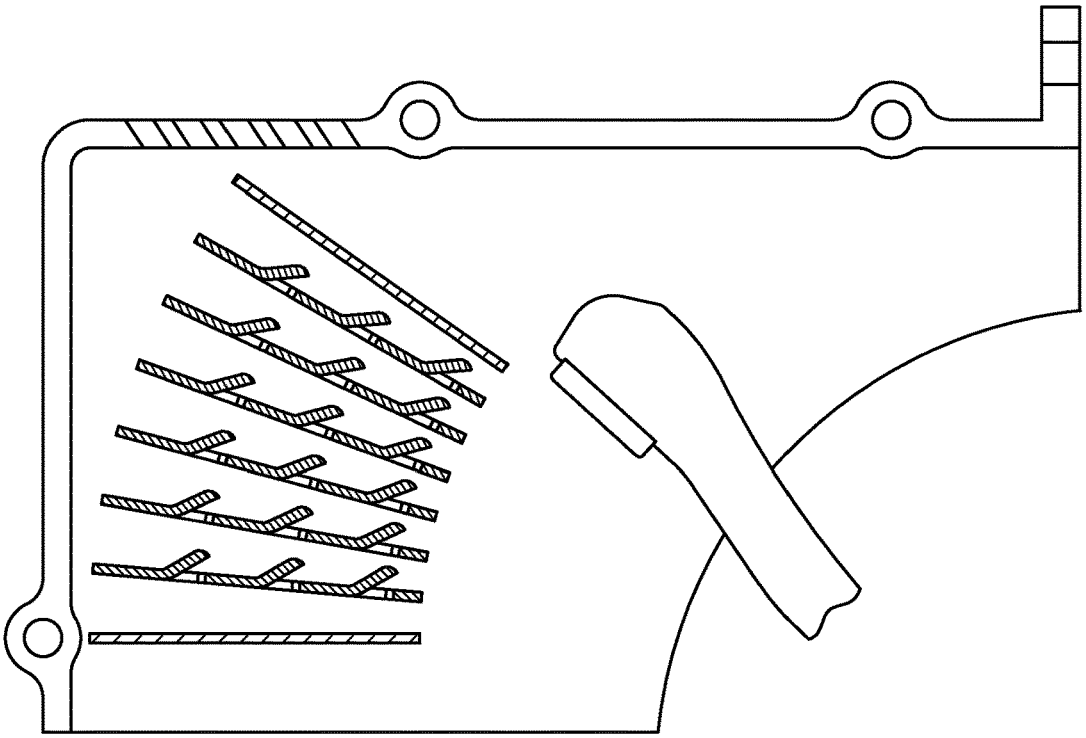
FIG. 30 is a front view of FIG. 29.

Referring to FIG. 29 and FIG. 30, a fifth arc quenching unit is disclosed by the invention, the fifth arc quenching unit comprises eight arc quenching plates and two electrically isolative housings suitable for mounting the arc quenching plate, one of electrically isolative housings has been removed, eight arc quenching plates are housed in two electrically isolative housings, six of the eight arc quenching plates are the third arc quenching plates 6 and two of the eight arc quenching plates are prior-art arc quenching plates, six third arc quenching plates are arranged between two prior-art arc quenching plates, adjacent arc quenching plates are spaced to form an arc channel suitable for receiving arcs. The mounting portion at two ends are embedded into a groove formed in the corresponding electrically isolative housing respectively, and the arc quenching plate is fixed inside a corresponding groove by screwing and fastening the two electrically isolative housings. When inflated gasses enter into arc channels, inflated gasses can be separated by the distributing parts 1, a part of gasses continue moving along current arc channel, and another part of gasses is guided into the through hole 3 under an effect of the inclined plane 2 and enters into an adjacent arc channel. When a long arc enters from the entrance of the arc quenching unit, the long arc is separated into seven small arcs by the eight arc quenching plates, separated small arcs continue propagating forwards inside the arc channel, when small arcs suffer from the distributing part 1, due to an effect of electromagnetic force or air flow, each small arc is separated into two sections by the corresponding inclined plane 2 of the corresponding distributing part 1, one section moves along an upper surface of the corresponding inclined plane 2 and continues moving forwards in current arc channel, and the other section passes through the corresponding through hole 3 along a lower surface of the corresponding inclined plane 2 to enter into an adjacent arc channel for forward movement. The separated arcs continue moving inside arc channel, and when arcs suffer from the distributing part again in moving process, arcs are separated according to the beforementioned separating rule again.

Embodiment 6

Figure 23:
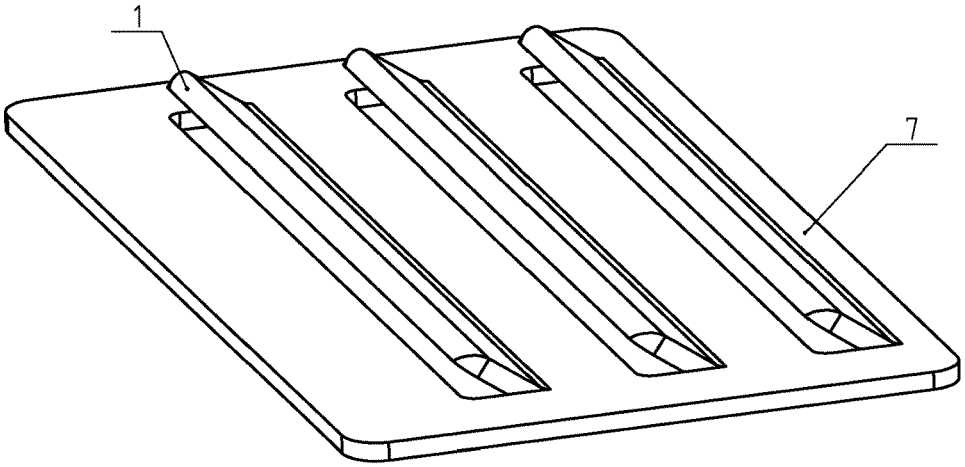
FIG. 23 is a perspective view of a fourth arc quenching plate according to Embodiment 6.
Figure 26:
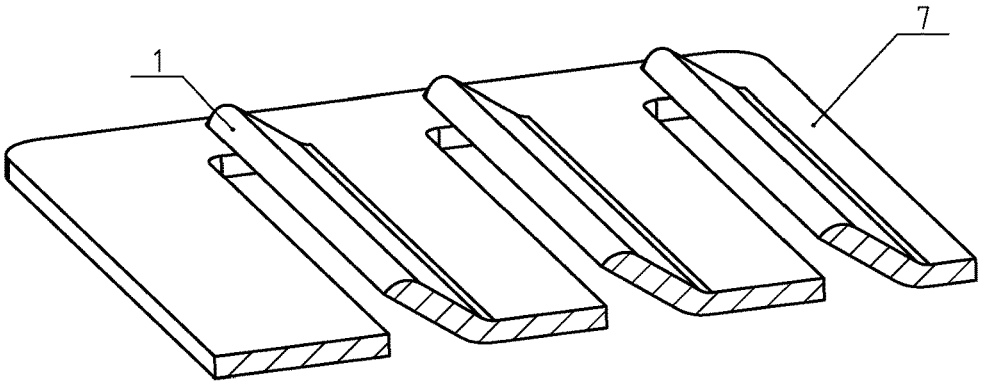
FIG. 26 is a sectional perspective view of FIG. 23.

Referring to FIG. 23 and FIG. 26, a fourth arc quenching plate 7 is disclosed by the invention, the fourth arc quenching plate 7 is obtained by moving three distributing parts 1 on the third arc quenching plate 6 according to Embodiment 5 towards a propagation direction of arc at intervals, a movement distance is half of a distance between two adjacent distributing parts 1, for a purpose that the third arc quenching plate 6 and the fourth arc quenching plate 7 are arranged in opposite directions, the distributing part 1 on the third arc quenching plate 6 and the distributing part 1 on the fourth arc quenching plate 7 are staggered from one another.

Figure 31:
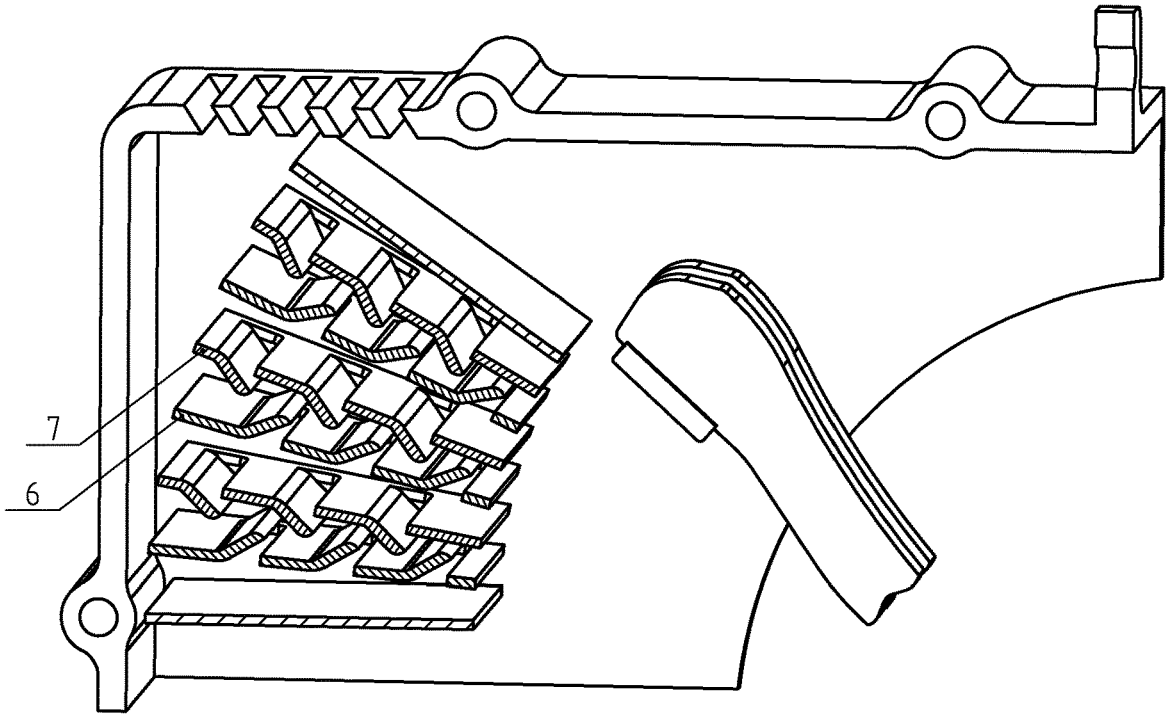
FIG. 31 a sectional view of a sixth arc quenching unit according to Embodiment 6.
Figure 32:
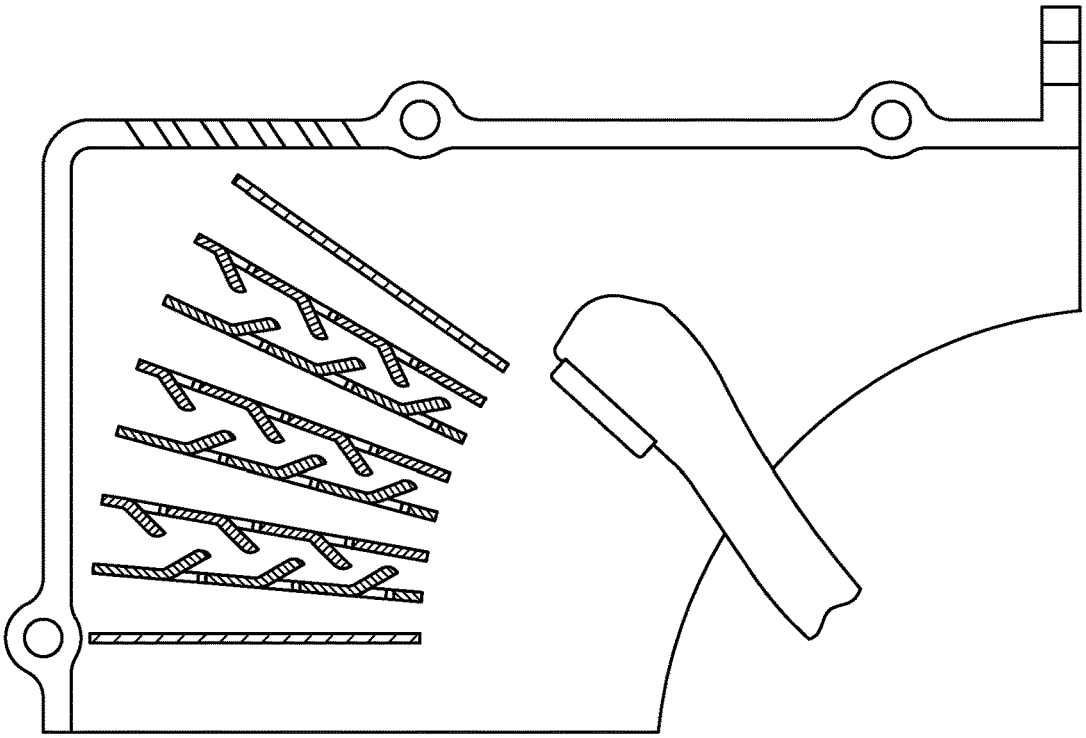
FIG. 32 is a front view of FIG. 31.

Referring to FIG. 31 and FIG. 32, a sixth arc quenching unit is disclosed by the invention, the three third arc quenching plates 4 in the fifth arc quenching unit according to Embodiment 5 are substituted for the fourth arc quenching plates 7 so that the third arc quenching plate 6 and the fourth arc quenching plate 7 are arranged alternately, and the inclined plane 3 of the third arc quenching plate 6 and the inclined plane 2 of the fourth arc quenching plate 7 are staggered and arranged in opposite directions.

The arc quenching plate and the arc quenching unit disclosed by the invention also can be used for quenching arcs generated when a moving contact and a stationary contact located are separated in liquid.

The invention claimed is:

1. A switching device comprises a movable contact, a stationary contact and an arc quenching unit for extinguishing arcs built between the movable contact and the stationary contact when the contacts are separated from each other, the arc quenching unit comprising a plurality of arc quenching plates and an electrically isolative housing suitable for mounting the plurality of arc quenching plates, the plurality of arc quenching plates adjacent to each other being spaced to form an arc channel suitable for receiving arcs, each one of the plurality of arc quenching plates comprising a mounting portion suitable for mounting and a receiving portion suitable for receiving arcs; wherein the receiving portion comprises a distributing part (1) suitable for separating arcs, the distributing part (1) comprising a through hole (3) penetrating through the receiving portion and an inclined plane (2) protruding from the receiving portion, the inclined plane (2) being arranged to a side of the through hole (3) away from an arc entrance and extending to the arc entrance, an angle between the inclined plane (2) and the receiving portion being an acute angle, a root of the inclined plane (2) being continuous with the receiving portion, the receiving portion comprising one distributing part (1) or a plurality of distributing parts (1), an inclined plane (2) of a first arc quenching plate (4) is interlacing and opposite with an inclined plane (2) of a second arc quenching plate (5).

* * * * *